US006932074B2

(12) United States Patent
Cheng et al.

(10) Patent No.: US 6,932,074 B2
(45) Date of Patent: Aug. 23, 2005

(54) TILE POSITIONING DEVICE FOR A TILE CUTTING MACHINE

(75) Inventors: Chin Ming Cheng, Taiping (TW); Chou Jenq Lin, TaLi (TW)

(73) Assignee: Motomax Electric Co., Ltd., Taichung Hsien (TW)

( * ) Notice: Subject to any disclaimer, the term of this patent is extended or adjusted under 35 U.S.C. 154(b) by 10 days.

(21) Appl. No.: 10/704,794

(22) Filed: Nov. 12, 2003

(65) Prior Publication Data

US 2005/0098166 A1 May 12, 2005

(51) Int. Cl.[7] ..... B28D 1/04

(52) U.S. Cl. ..... 125/13.01; 125/35

(58) Field of Search ..... 125/13.01, 35; 83/435.12, 435.14, 472, 473, 486, 486.1

(56) References Cited

U.S. PATENT DOCUMENTS

| | | | | |
|---|---|---|---|---|
| 5,615,665 | A * | 4/1997 | Thiriet | 125/23.02 |
| 5,832,913 | A * | 11/1998 | Arends | 125/13.01 |
| 6,012,441 | A * | 1/2000 | Liu | 125/35 |
| 6,164,272 | A * | 12/2000 | Fouy | 125/12 |
| 6,427,677 | B1 * | 8/2002 | O'Banion et al. | 125/23.02 |
| 6,494,198 | B1 * | 12/2002 | Chen | 125/13.01 |
| 6,508,244 | B2 * | 1/2003 | Lee | 125/12 |

* cited by examiner

*Primary Examiner*—Eileen P. Morgan
(74) *Attorney, Agent, or Firm*—Bacon & Thomas PLLC

(57) ABSTRACT

A tile positioning device of a tile cutting machine includes a first piece slidably engaged with the gauge and a second piece is pivotably connected to the first piece. The second piece includes two protrusions and a right angle is defined between two surfaces of the two protrusions for clamping two sides of a tile and the tile can be rotated relative to the blade of the cutting machine by rotating the second piece. A third piece is optionally and pivotably connected to one of the two protrusions for adjusting the positioning of the tile.

9 Claims, 9 Drawing Sheets

TILE POSITIONING DEVICE FOR A TILE CUTTING MACHINE

FIELD OF THE INVENTION

The present invention relates to a tile positioning device of a tile cutting machine wherein the positioning device allows the tile to be positioned at desired angles.

BACKGROUND OF THE INVENTION

A conventional tile cutting machine 10 is shown in FIGS. 1 and 2 and generally includes a base 11 with a chamber 12 defined therein in which a motor (not shown) and a blade 14 are installed. A cover 13 is used to close the chamber and is in flush with the top surface of the tile cutting machine 10. The blade 14 extends from a slot defined through the top surface of the base 11 so as to cut the tile 20 positioned on the top surface of the machine 10. A gauge 16 is mounted about the top surface of the machine 10 and two ends of the gauge 16 are slidably engaged with two rails 15 on two sides of the base 10. A positioning device 17 includes a plate which includes a straight side 171 and a recess 172, wherein the straight side 171 is used to slidably contact on a side of the gauge and two sides of the tile 20 can be guided by two sides of the recess 172. Nevertheless, the plate of the positioning device 17 is not engaged with the gauge 16 so that it is not well positioned when moving along the side of the gauge 16. Furthermore, a distance between the blade 14 and the end of the base 11 is fixed so that the cutting machine 10 cannot cut a tile having a large size.

The present invention intends to provide a tile positioning device that is connected to the gauge and includes a pivotable portion so as to rotate the tile relative to the blade. Besides, the gauge is connected to two extension rods so that the distance between the blade and the gauge can be extended.

SUMMARY OF THE INVENTION

The present invention relates to a tile cutting machine which comprises a base having two rails on two sides thereof and a blade rotatably extends through a slot defined through a top surface of the base. A gauge is slidably mounted between two rails and a positioning device is slidably engaged with the gauge. The positioning device comprises a first piece which has an engaging wall extending from an underside thereof and the engaging wall is slidably engaged with a side of the gauge. A second piece has a connection portion which is pivotably mounted to the first piece. A curve slot is defined through the connection portion and a positioning bolt extends through the curve slot and is connected to the first piece. An engaging portion is connected to the connection portion and has a first protrusion and a second protrusion. The first protrusion has a first surface and the second protrusion has a second surface. A right angle is clamped between the first surface and the second surface.

The present invention will become more apparent from the following detailed description when taken in connection with the accompanying drawings which show, for purposes of illustration only, a preferred embodiment in accordance with the present invention.

DETAILED DESCRIPTION OF THE PREFERRED EMBODIMENT

Figure 1:
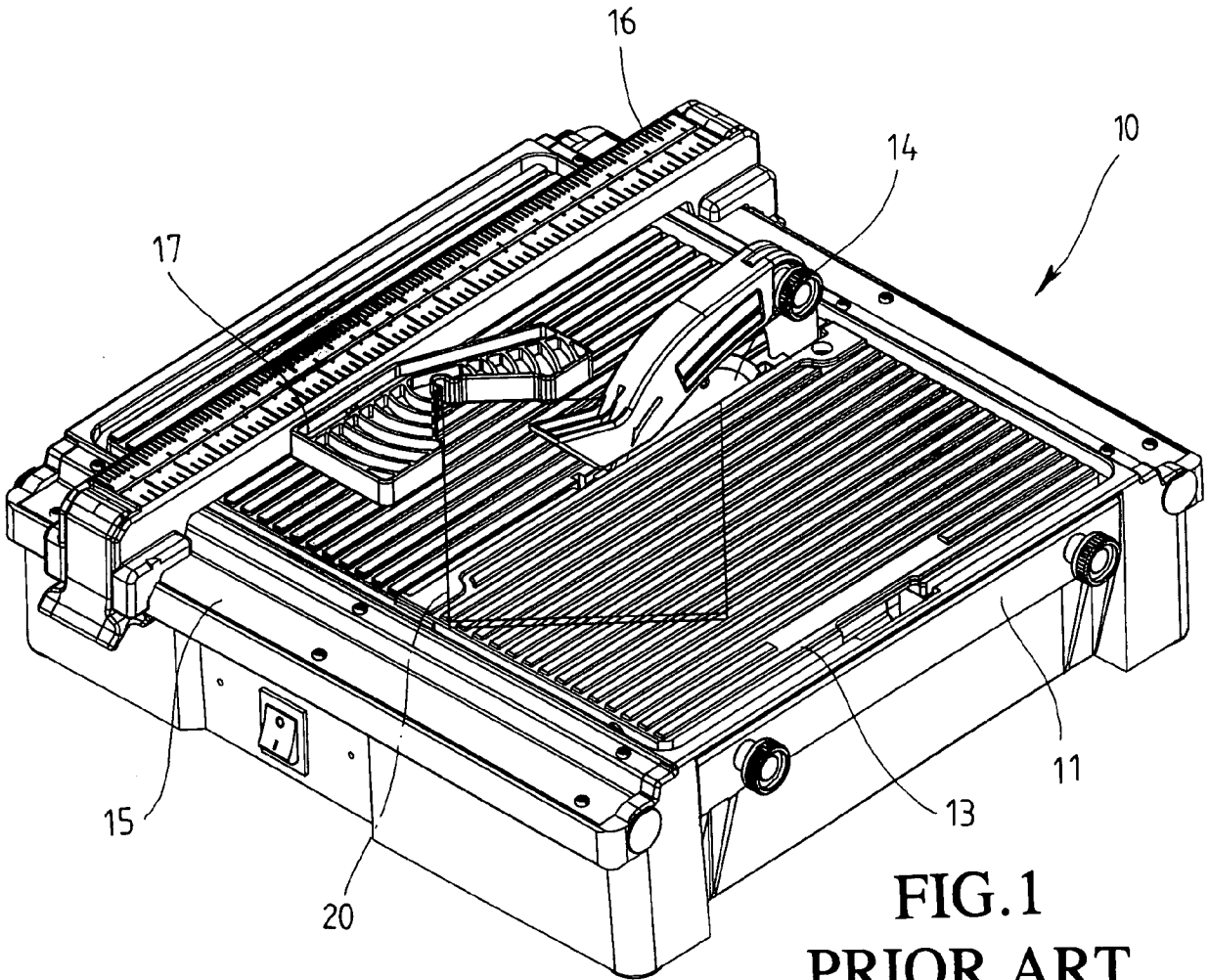
FIG. 1 PRIOR ART
FIG. 1 is a perspective view to show a conventional tile cutting machine.
Figure 2:
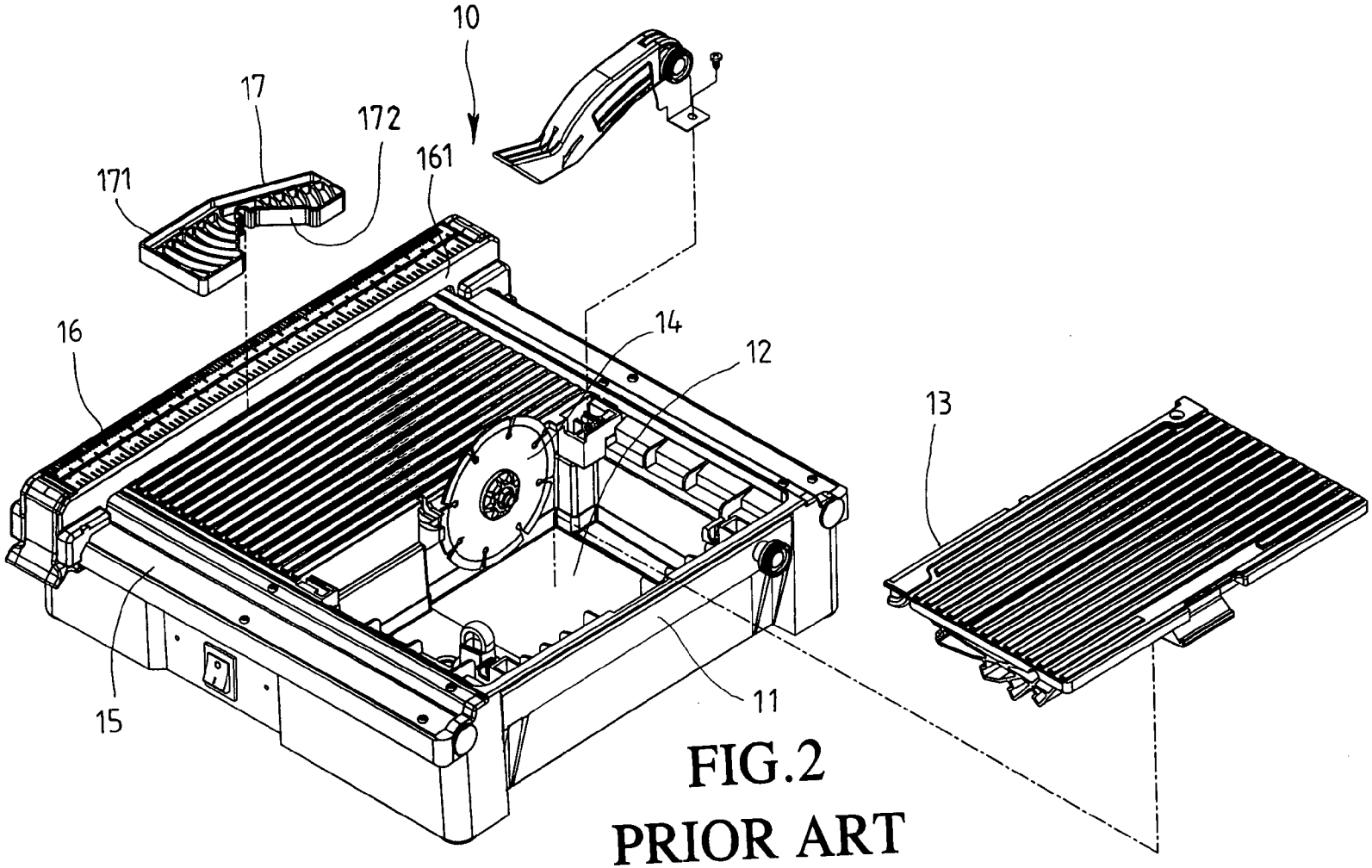
FIG.2 PRIOR ART
FIG. 2 is an exploded view to show the conventional tile cutting machine.
Figure 3:
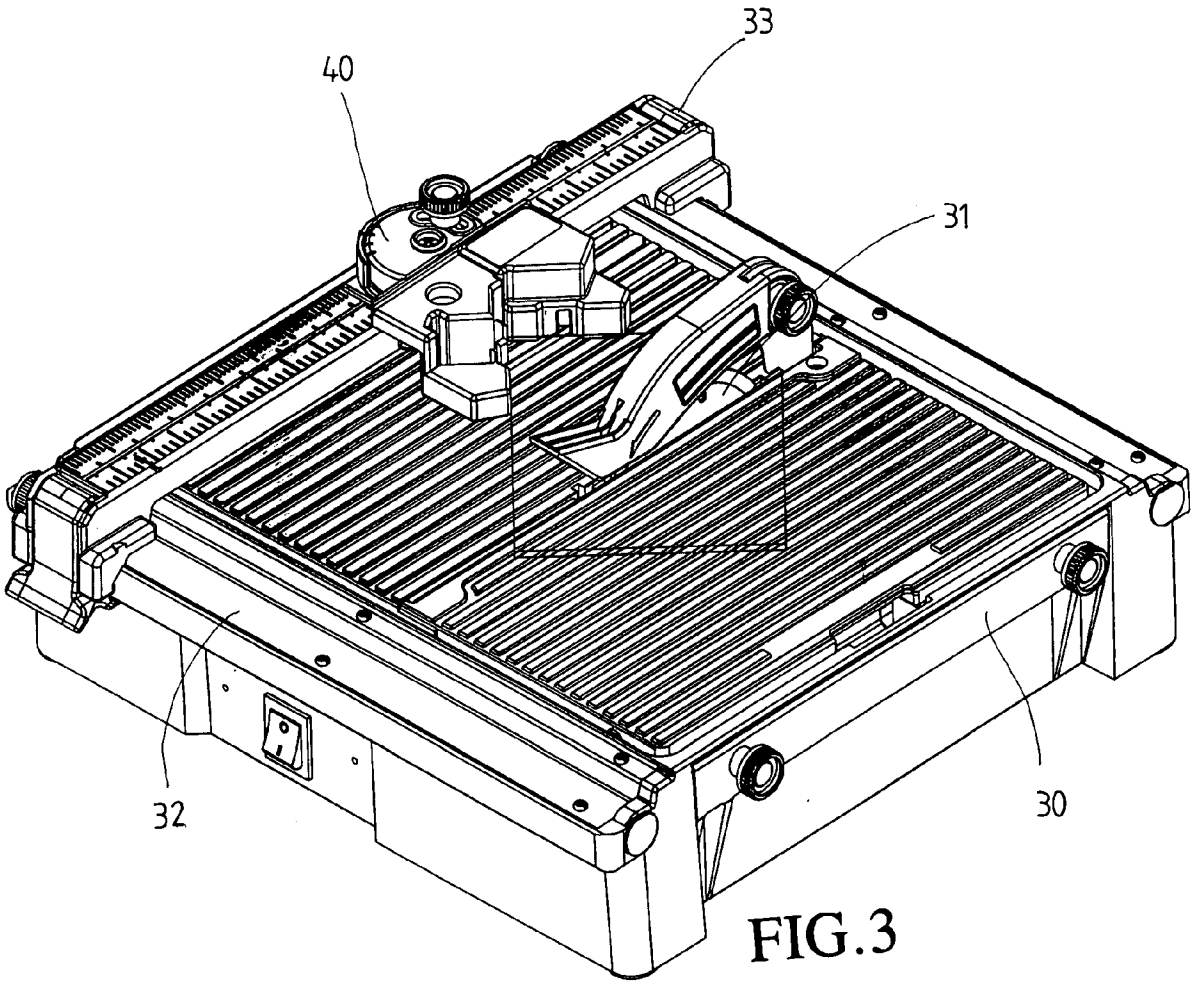
FIG. 3 is a perspective view to show the tile cutting machine of the present invention.
Figure 4:
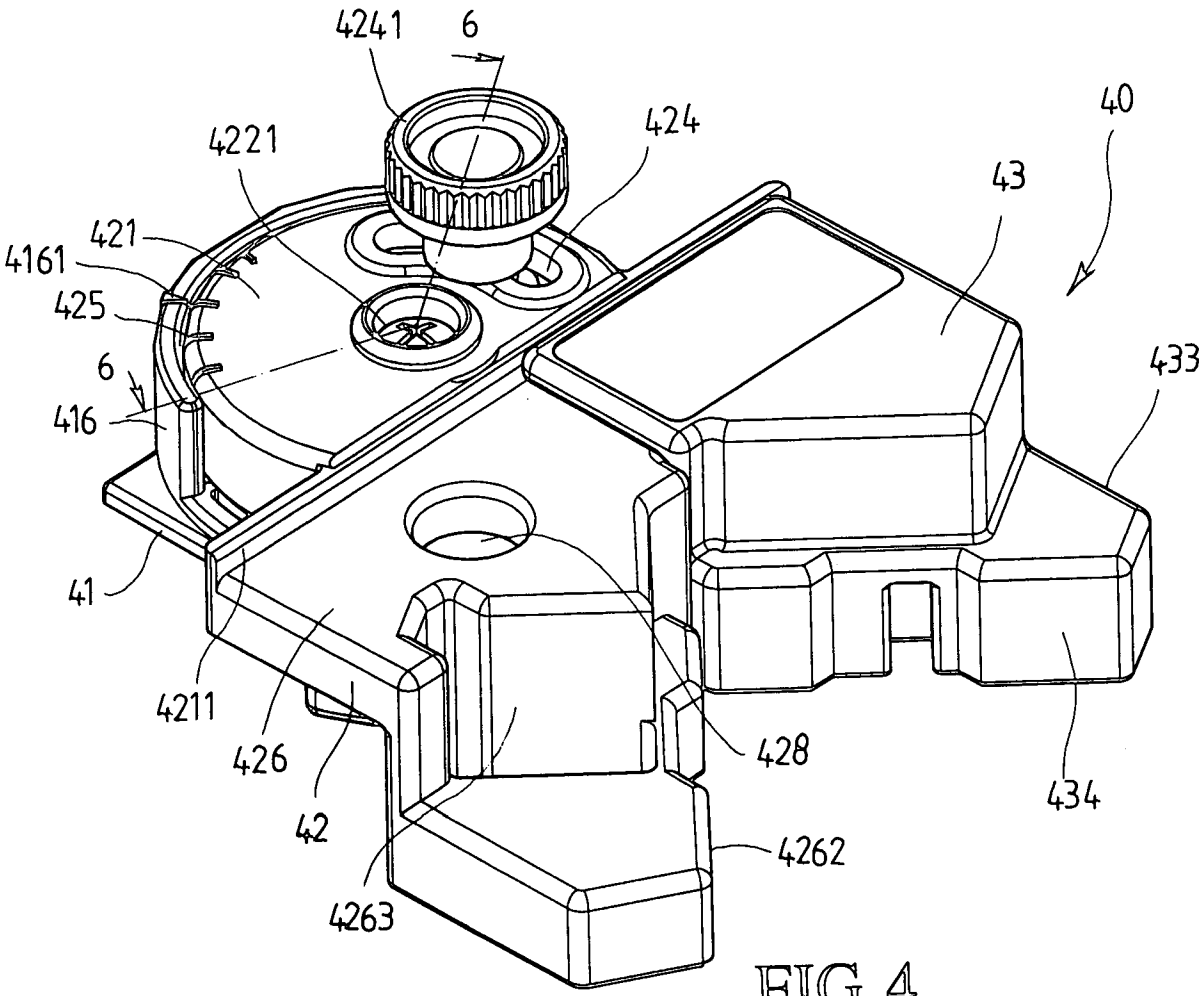
FIG. 4 is a perspective view to show the tile positioning device of the present invention.
Figure 5:
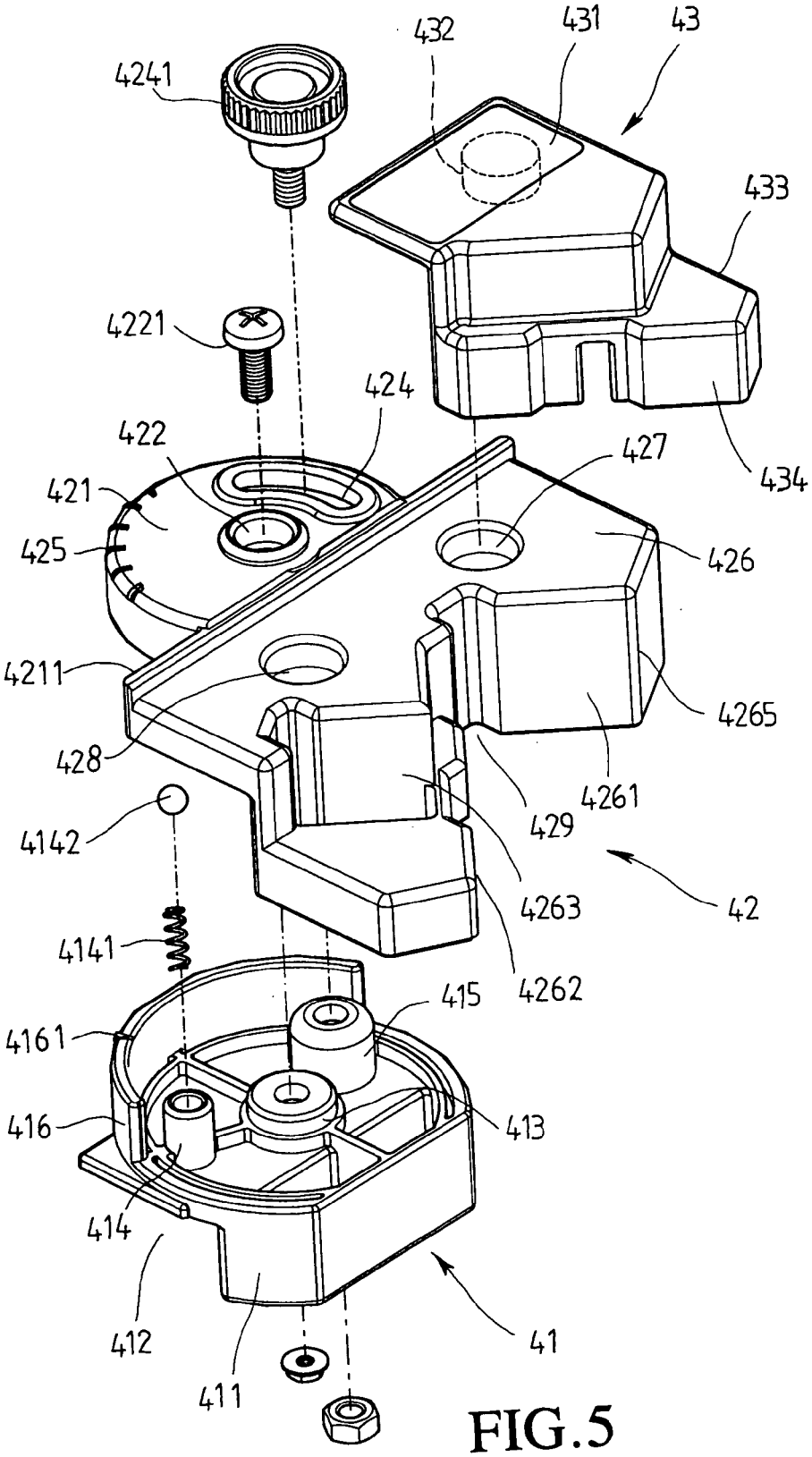
FIG. 5 is an exploded view to show the tile positioning device of the present invention.

Referring to FIGS. 3 to 5, the tile cutting machine of the present invention comprises a base 30 having two rails 32 on two sides thereof and a blade 31 rotatably extends through a slot defined through a top surface of the base 30. A fence is pivotably mounted to the blade 31. A gauge 33 is slidably mounted between two rails 32 and a positioning device 40 is slidably engaged with an inside side of the gauge 33.

The positioning device 40 comprises a first piece 41 which has an engaging wall 411 extending from an underside thereof and a first tube 413, a second tube 414 and a third tube 415 respectively extend from a top of the first piece 41. The second tube 414 located at a center of the first piece 41. A spring 4141 and a bead 4142 are received in the second tube 414. The first piece 41 is overlapped on the gauge 33 and the gauge 33 is engaged with the recess 412 defined by the engaging wall 411 and the horizontal portion of the first piece 41, such that an inside of the engaging wall 411 slidably contacts an inside of the gauge 33. The first piece 41 further has a curved wall 416 extending from the top thereof and an index 4161 is marked on the curved wall 416.

Figure 7:
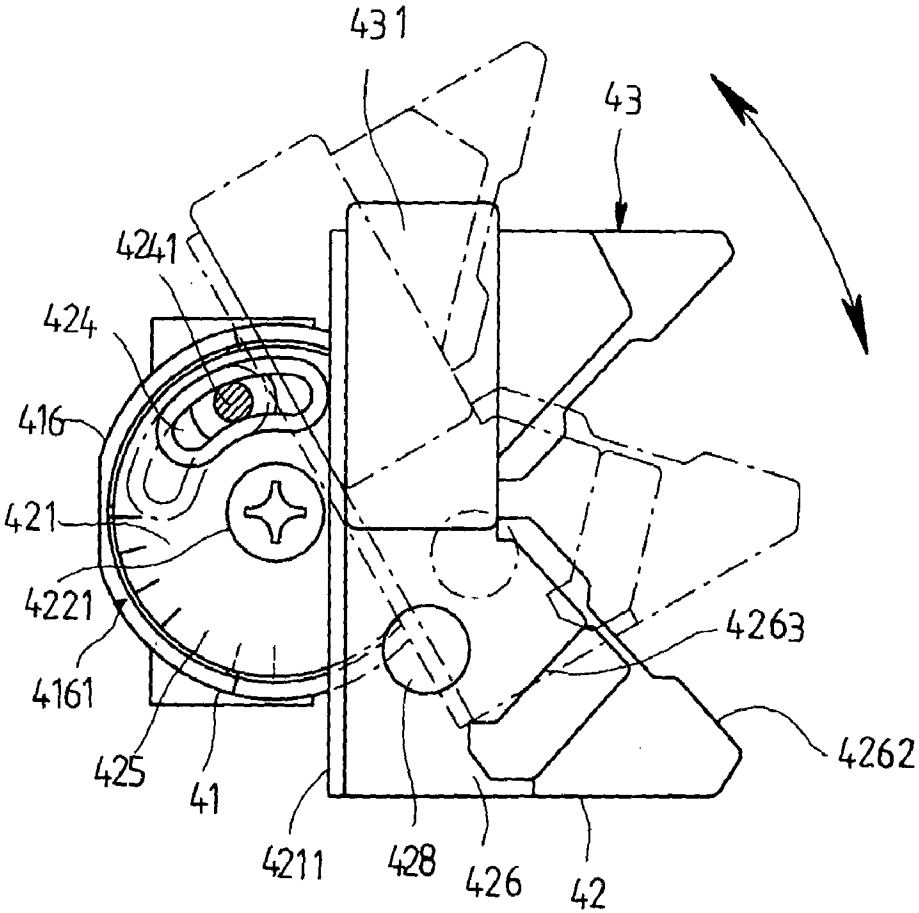
FIG. 7 shows the tile positioning device is pivoted relative to the gauge.
Figure 6:
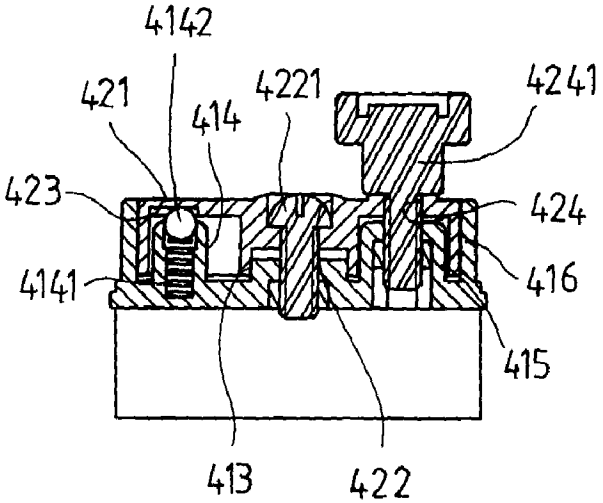
FIG. 6 is a cross sectional view to show the bead on the first piece is engaged with one of notches in the underside of the second piece of the tile positioning device of the present invention.

A second piece 42 has a connection portion 421 which is pivotably mounted to the first piece 41 by extending a bolt 4221 through a hole 422 defined in the second piece 42 and then the first tube 413, and engaged with a nut. The second piece 42 has a curved outer periphery and a plurality of angle markings 425 are marked on the second piece 42. Further referring to FIG. 7, the curved outer periphery of the second piece 42 is engaged with an inside surface of the curved wall 416 so that the second piece 42 can be rotated about the bolt 4221 to selectively dispose any of the angle markings 424 is in alignment with the index 4161. A curve slot 424 is defined through the connection portion 421 and a positioning bolt 4241 extends through the curve slot 424 and the third tube 415 on the first piece 41, and engaged with a nut. The positioning bolt 4241 fixes the second piece 42 relative to the first piece 41 when a desired angle is set. Further referring to FIG. 6, the second piece 42 has a plurality of notches 423 defined in an underside thereof so that the bead 4142 is engaged with any one of the notches 423, to help the user to know that the second piece 42 is positioned relative to the first piece 41.

An engaging portion 426 is connected to the connection portion 421 and includes a first protrusion and a second protrusion. A stop wall 4211 is located at an end of the engaging portion 426. The first protrusion has a first surface 4261 and the second protrusion has a second surface 4262. A right angle portion of a tile is clamped between the first surface 4261 and the second surface 4262. A recess 429 is defined between the first surface 4261 and the second surface 4262 such that a corner of the tile, as shown in FIG. 3, can be engaged within the recess 429 and two sides of the tile are clamped by the first surface 4261 and the second surface 4262.

The first and second protrusions of the engaging portion 426 of the second piece 42 each have a hole 427/428 defined in a top thereof. A third piece 43 has an extension plate 431 and a mounting member is connected to the extension plate 431. A rod 432 extends from an underside of the extension plate 431 and is rotatably engaged with one of the two holes 427, 428 of the first and second protrusions of the engaging portion 426 of the second piece 42 as shown in FIGS. 8 and 9.

Figure 8:
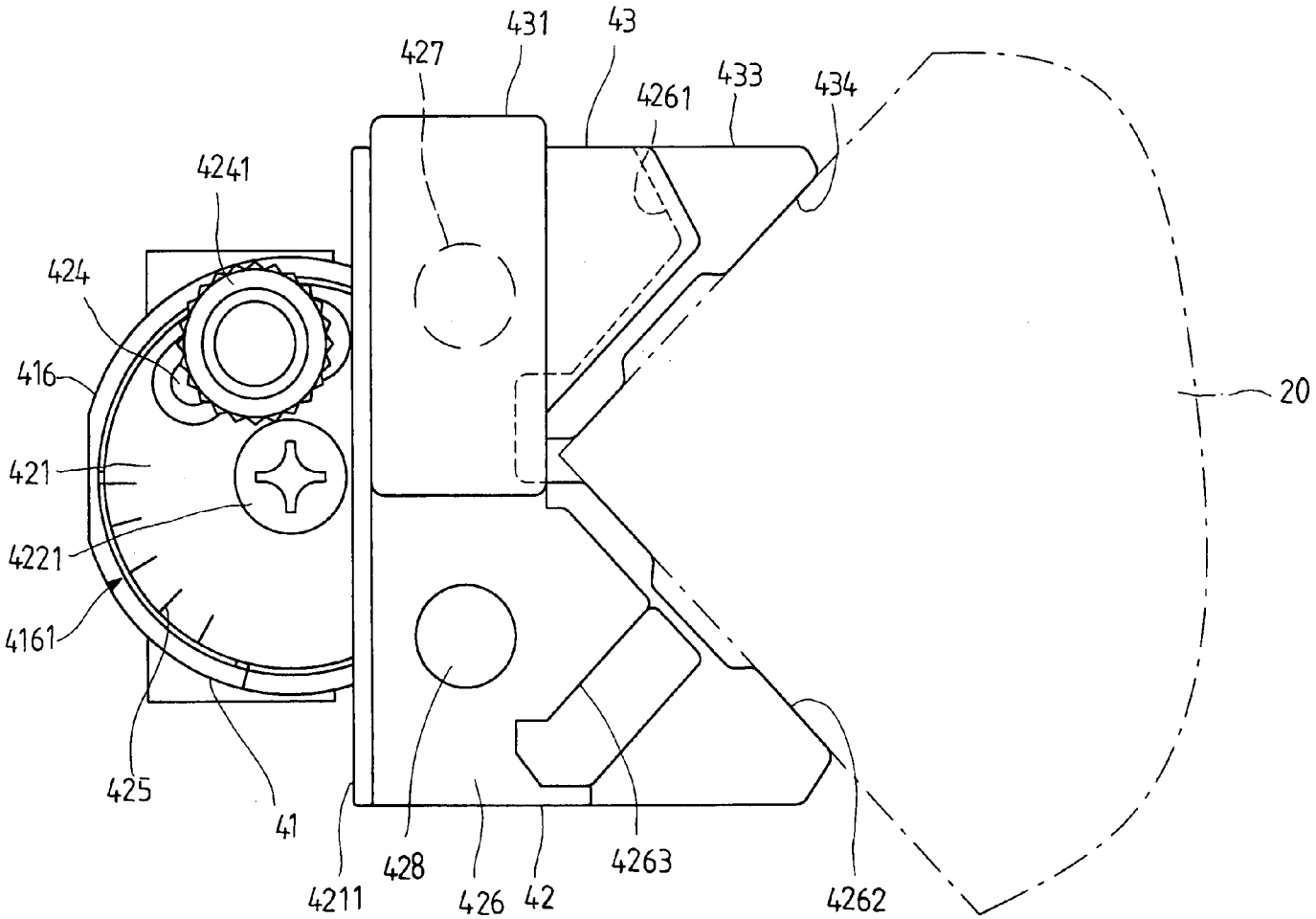
FIG. 8 shows the third piece is connected to the first protrusion of the second piece.

As shown in FIG. 8, the mounting member is mounted to the first protrusion of the engaging portion 426 of the second piece 42 and has a third surface 434 which is matched with the first surface 4261 of the engaging portion of the second piece 42. The two sides of the tile 20 can be clamped by the second surface 4262 and the third surface 434, and the tile 20 can be cut at 45 degrees by the blade 31.

Figure 9:
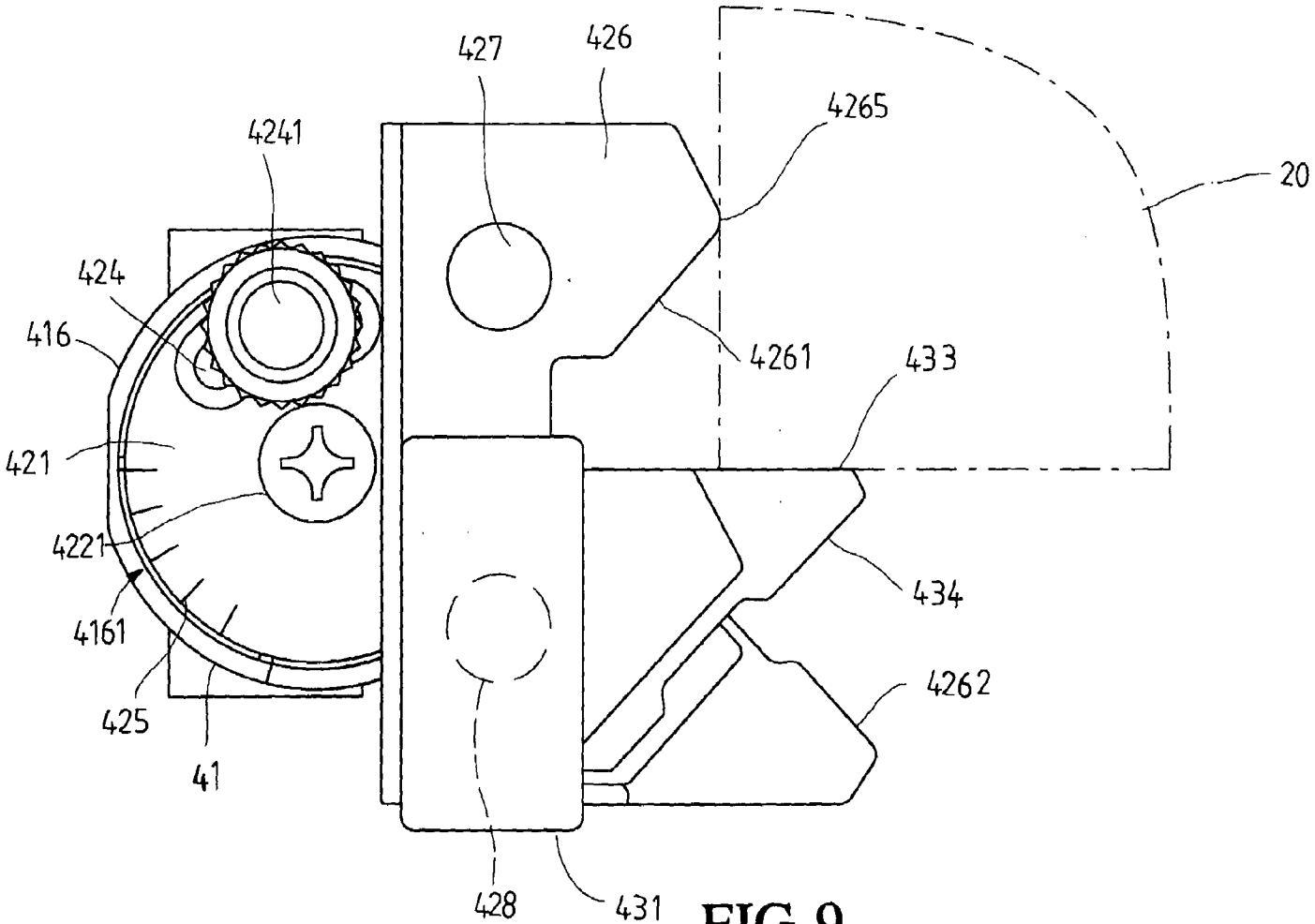
FIG. 9 shows the third piece is connected to the second protrusion of the second piece.

Referring to FIGS. 5 and 9, the second protrusion of the engaging portion 426 of the second piece 42 includes a fourth surface 4263 which is parallel to the first surface 4261 of the first protrusion. The mounting member is mounted to the second protrusion of the engaging portion 426 of the second piece 42 and the third surface 434 is matched with the fourth surface 4263 of the first protrusion of the engaging portion 426 of the second piece 42. The mounting member has a straight side 433 located in opposite to the third surface 434. Therefore, one side of the tile 20 contacts the tip portion 4265 of the first protrusion and the other side of the tile 20 contacts the straight side 433 of the third piece 43. At this position, the tile 20 can be cut in a direction parallel to the blade 31.

Figure 10:
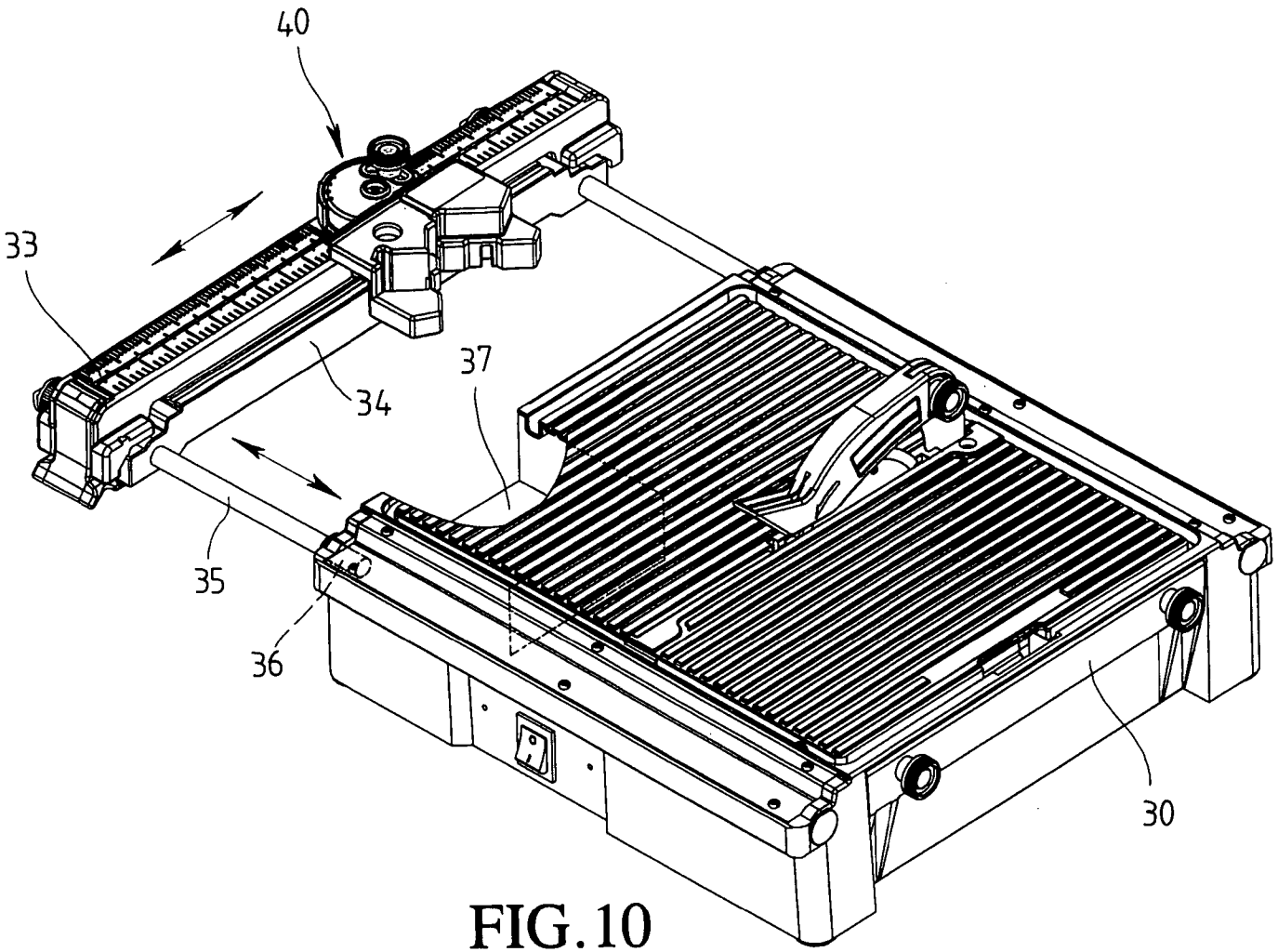
FIG. 10 shows the gauge is connected to two extension rods.

Referring to FIG. 10, the gauge 33 is fixed on a support member 34 and two extension rods 35 are connected to the support member 34. The two extension rods 35 are retractably received in two passages 36 defined in the base 30 such that the gauge 33 can be pulled away from the blade 31 so that a tile with a large size can be cut on the top of the cutting machine. The base 30 further has a chamber 37 defined in an end thereof so as to receive accessories and the support member 34 closes an opening of the chamber 37 when the support member 34 is pushed to contact the base 30.

While we have shown and described the preferred embodiment in accordance with the present invention, it should be clear to those skilled in the art that further embodiments may be made without departing from the scope of the present invention.

What is claimed is:

1. A tile cutting machine comprising:

a base having two rails on two sides of the base;

a blade rotatably extending through a slot defined through a top surface of the base;

a gauge mounted between the two rails for slidable movement towards and away from the blade;

a positioning device including a first piece and a second piece, the first piece having an engaging wall extending from an underside thereof, the engaging wall being slidably engageable with a side of the gauge, and the second piece having a connection portion pivotally mounted to the first piece, a curve slot defined through the connection portion and a positioning bolt extending through the curve slot and connected to the first piece, an engaging portion connected to the connection portion, the engaging portion defining a first protrusion and a second protrusion, the first protrusion having a first surface and the second protrusion having a second surface, the first surface and the second surface forming a right angle for clamping a tile therebetween.

2. The tile cutting machine as claimed in claim 1, wherein the first piece has a curved wall extending from a top thereof, an index marked on the curved wall, the connection portion of the second piece having a curved outer periphery, a plurality of angle markings are marked on the connection portion, the curved outer periphery of the second piece being engageable with an inside surface of the curved wall of the first piece so that the angle marking may selectively be disposed in alignment with the index.

3. The tile cutting machine as claimed in claim 1, wherein a tube extends from a top of the first piece and a spring and a bead are received in the tube, the second piece having a plurality of notches defined in an underside for selective engagement by the bead.

4. The tile cutting machine as claimed in claim 1, wherein the first and second protrusions of the engaging portion of the second piece each have a hole defined in a top portion thereof, and including a third piece having an extension plate, a rod extending from an underside of the extension plate, the rod being rotatably and selectively engageable within one of the two holes of the first and second protrusions of the engaging portion of the second piece.

5. The tile cutting machine as claimed in claim 4, to wherein the rod is engaged within the hole of the first protrusion of the engaging portion of the second piece, and has a third surface of the third piece disposed in alignment with the first surface of the first protrusion of the second piece.

6. The tile cutting machine as claimed in claim 4, wherein the second protrusion of the engaging portion of the second piece includes a fourth surface which is parallel to the first surface of the first protrusion, and when the rod is engaged within the hole of the second protrusion of the engaging portion of the second piece, the third surface is disposed in alignment with the fourth surface of the second protrusion of the engaging portion of the second piece.

7. The tile cutting machine as claimed in claim 4, wherein the has third piece includes a straight side disposed opposite to the third surface.

8. The tile cutting machine as claimed in claim 1, wherein the gauge is fixed on a support member, a pair of extension rods connected to the support member, the pair of extension rods slidably received in a pair of passages in the base for moving the support member towards and away from the blade.

9. The tile cutting machine as claimed in claim 8, wherein the base includes a chamber defined in an end thereof and the support member closes an opening of the chamber when the support member is moved towards the blade.

* * * * *